US011220378B2

(12) United States Patent
Garcia Alberola

(10) Patent No.: US 11,220,378 B2
(45) Date of Patent: Jan. 11, 2022

(54) CAP FOR A DRINK BOTTLE OR SIMILAR RECIPIENT

(71) Applicant: Manufacturas Inplast, S.A., Alicante (ES)

(72) Inventor: Jose Maria Garcia Alberola, Alicante (ES)

(73) Assignee: Manufacturas Inplast, S.A., Aspe (ES)

( * ) Notice: Subject to any disclaimer, the term of this patent is extended or adjusted under 35 U.S.C. 154(b) by 115 days.

(21) Appl. No.: 16/498,467

(22) PCT Filed: Mar. 22, 2018

(86) PCT No.: PCT/ES2018/070220
§ 371 (c)(1),
(2) Date: Sep. 27, 2019

(87) PCT Pub. No.: WO2018/178448
PCT Pub. Date: Oct. 4, 2018

(65) Prior Publication Data

US 2021/0107709 A1 Apr. 15, 2021

(30) Foreign Application Priority Data

Mar. 30, 2017 (ES) ..... ES201700233U

(51) Int. Cl.
*B65D 47/08* (2006.01)
*B65D 41/34* (2006.01)

(52) U.S. Cl.
CPC ..... *B65D 47/0838* (2013.01); *B65D 41/34* (2013.01)

(58) Field of Classification Search
CPC ..... B65D 47/0838; B65D 41/34; B65D 41/3442; B65D 41/3447
USPC ..... 215/235
See application file for complete search history.

(56) References Cited

U.S. PATENT DOCUMENTS 10,926,923 B2 * 2/2021 Berroa Garcia ..... B65D 41/32
2002/0096532 A1 * 7/2002 Berge ..... B65D 47/0819 220/831
2012/0067922 A1 * 3/2012 Benoit-Gonin ..... B65D 55/024 222/153.06

FOREIGN PATENT DOCUMENTS

EP 3020651 A1 5/2016
ES 2366276 T3 10/2011
WO 2015121177 A1 8/2015

OTHER PUBLICATIONS

Jul. 25, 2018—(WO) International Search Report—PCT/ES2018/070220.

* cited by examiner

*Primary Examiner* — Ernesto A Grano
*Assistant Examiner* — Elisabeth Sullivan
(74) *Attorney, Agent, or Firm* — Banner & Witcoff, Ltd.

(57) ABSTRACT

Cap for drink bottle or similar recipient that comprises a base element comprising a drinking nozzle and a substantially tubular portion adapted to be secured to a neck of the bottle or recipient, a covering element comprising a flip top adapted to hermetically seal the drinking nozzle of the base element, and anti-tamper means of the top adapted to provide a visual indication of whether the top has already been removed for a first time from the drinking nozzle; the covering element comprises a tubular portion adapted to be secured to the outside of the substantially tubular portion of the base element, and the anti-tamper means of the top comprise an interlocking element extended from a lower edge of the top; wherein, the interlocking element is adapted to latch through the inside a front window of the tubular portion.

10 Claims, 3 Drawing Sheets

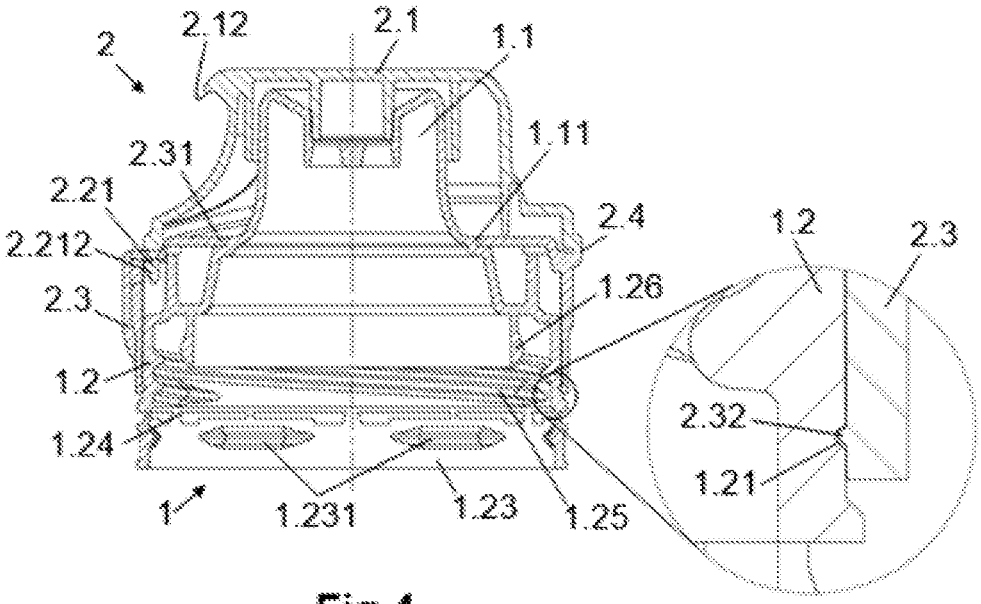
Fig.4
Fig.5
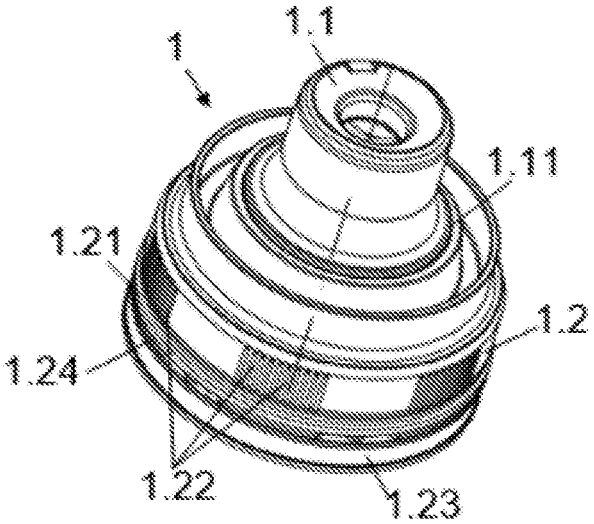
Fig.6

CAP FOR A DRINK BOTTLE OR SIMILAR RECIPIENT

The present application is a U.S. National Phase Application under 35 U.S.C. § 371 of PCT/ES2018/070220 filed Mar. 22, 2018, which claims priority to Spanish application (ES) U201700233, filed Mar. 30, 2017, the contents therein of the applications is incorporated by reference herein in its entirety.

TECHNICAL FIELD OF THE INVENTION

The present invention is encompassed in the field of caps that are arranged on the neck of a drink bottle or similar recipient with a view to promoting its hermetic closure, as well as leaving indications of whether, where appropriate, said cap has already been opened.

BACKGROUND OF THE INVENTION

Various types of closure devices are known which couple to the necks of bottles or similar recipients in the manner of a cap. Generally, said caps are made of moulded plastic, and comprise a substantially tubular base element, adapted to be secured to the neck of the bottle or similar recipient, and a removable top, normally, foldably joined to the base element, for example, by means of a hinge section.

The top is adapted to hermetically seal an outlet spout or drinking nozzle of the base element. Thus, in a first position of use of the cap, the top is closing the nozzle for drinking the liquid from the bottle, and then, in a second position of use, said top is uncoupled from the drinking nozzle, for example, when the user is about to consume the liquid contained in the bottle.

Likewise, before the first use of the cap, that is, before the top is removed for the first time from the drinking nozzle of the base element, it is common that the top and the base element, in addition to being joined by the hinge section, are connected to each other by anti-tamper means, which, when broken, at least partially, the first time the cap is opened, provide the user with clues or a visual indication that said cap has been opened previously.

The existence of any solution in the state of the art showing similar characteristics to those presented by the invention described herein is not known by the applicant.

DESCRIPTION OF THE INVENTION

This invention is established and characterised in the independent claims, while the dependent claims describe other characteristics thereof.

The object of the invention is a cap to be secured to the neck of a drink bottle or similar recipient.

The cap comprises:

- a base element comprising an upper drinking nozzle and a substantially tubular lower portion adapted so that the base element can be secured to the neck of the drink bottle or similar recipient,
- a covering element comprising a flip top adapted to hermetically seal the drinking nozzle of the base element, and
- anti-tamper means of the top adapted to provide a visual indication of whether the top has already been removed for a first time from the drinking nozzle.

Additionally, the covering element comprises a tubular portion, which is adapted to be secured to the outside of the substantially tubular portion of the base element.

For its part, the anti-tamper means of the top comprise an interlocking element extended from a lower edge of the top. The interlocking element is adapted to latch through the inside of a front window of the tubular portion.

Thus, when attempting to remove the top from the drinking nozzle for the first time, the interlocking element breaks and falls from the front window of the tubular portion that retained it, so the back of said front window is no longer visible, which provides a visual indication that the top has already been removed and that the contents of the bottle may have been tampered with.

BRIEF DESCRIPTION OF THE DRAWINGS

This specification is supplemented by a set of drawings illustrating the preferred embodiment but which are never intended to limit the invention.

FIG. 4 represents a sectional side view of the cap of FIGS. 1 and 2, with the top in the closed position.

FIG. 5 represents an enlarged detail of FIG. 4.

FIG. 6 represents a top perspective view of the base element of the cap of FIGS. 1 and 2.

DETAILED DESCRIPTION OF THE INVENTION

Figure 1:
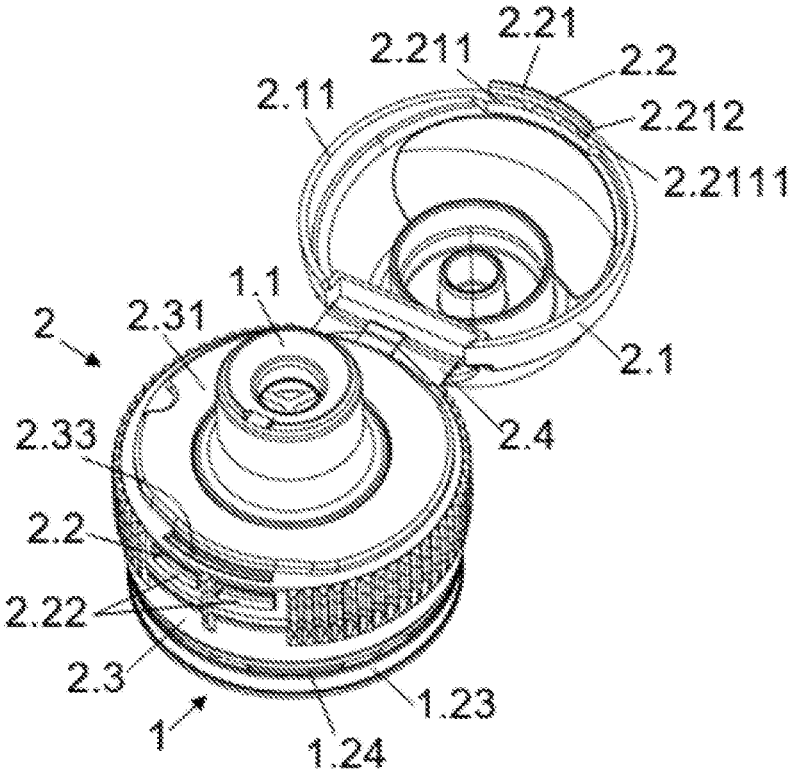
FIG. 1 represents a top perspective view of the cap for drink bottles or similar recipients with the top in the open position.
Figure 2:
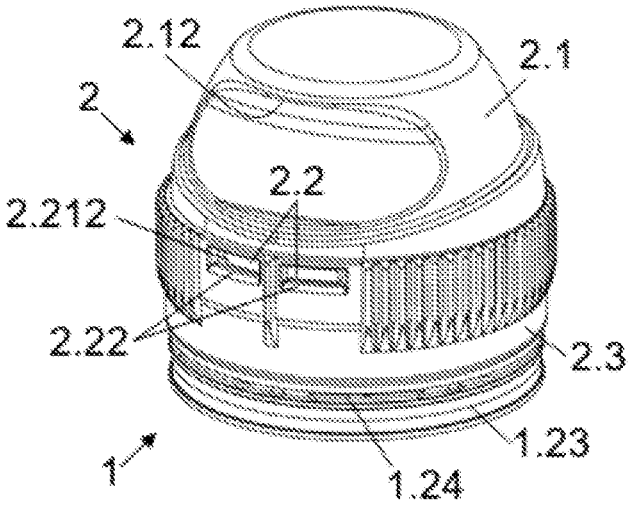
FIG. 2 represents a top perspective view of the cap of FIG. 1 with the top in the closed position.

The present invention is a cap for a drink bottle or similar recipient.

As shown in the figures, the cap comprises:

- a base element (1), shown in FIGS. 3 to 6, comprising an upper drinking nozzle (1.1) and a substantially tubular lower portion (1.2) adapted so that the base element (1) can be secured to a neck of the recipient (not shown in the figures),
- a covering element (2), shown in FIGS. 1 to 4, comprising a flip top (2.1) adapted to hermetically seal the drinking nozzle (1.1) of the base element (1), and
- anti-tamper means (2.2) of the top (2.1) adapted to provide a visual indication of whether the top (2.1) has already been removed for a first time from the drinking nozzle (1.1).

The covering element (2) comprises a tubular portion (2.3) adapted to be secured to the outside of the substantially tubular portion (1.2) of the base element (1). See FIGS. 3 and 4.

Figure 3:
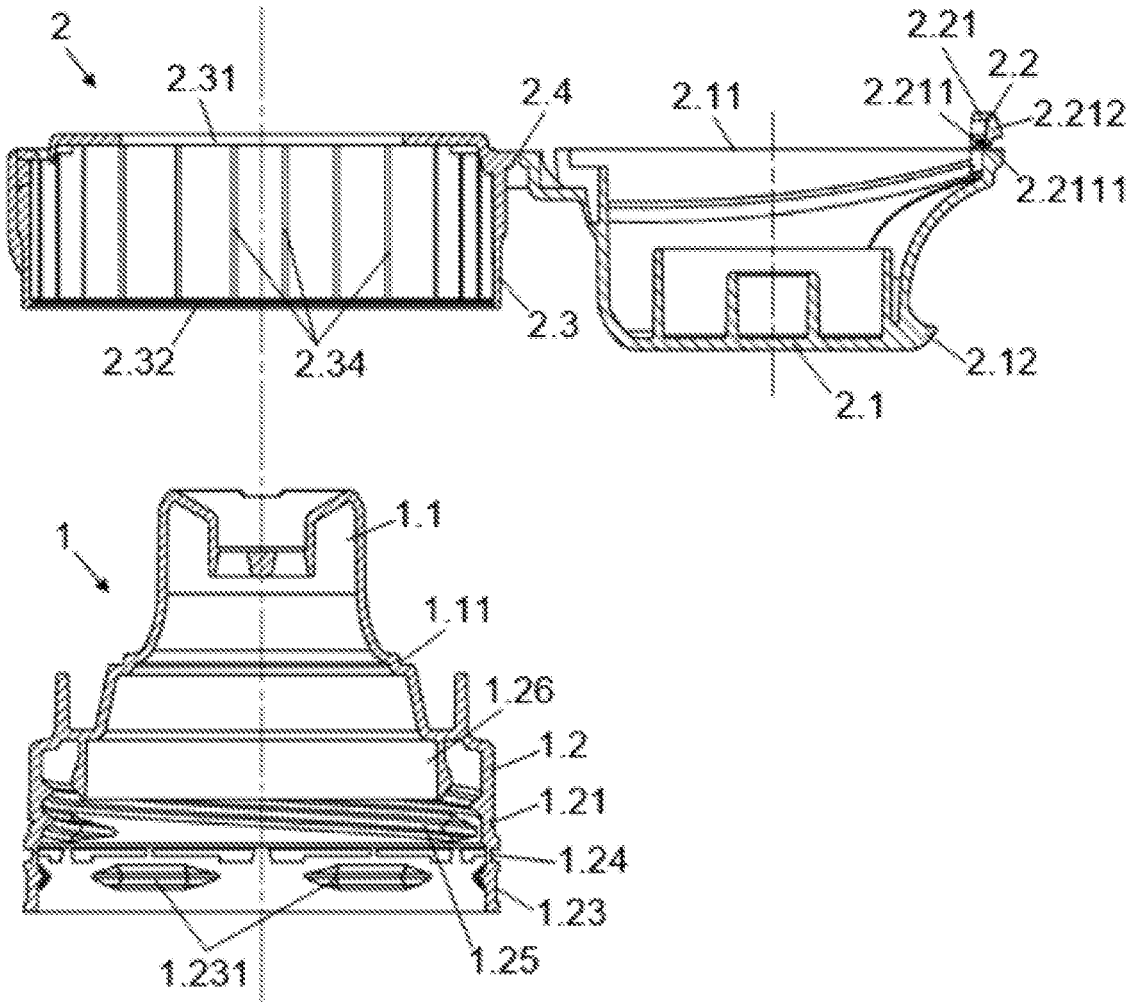
FIG. 3 represents an exploded side view of the cap of FIGS. 1 and 2, with the top in the open position.

Additionally, as shown in FIGS. 1 and 3, it is preferred that the covering element (2) comprises a hinge section (2.4), which joins the top (2.1) to the tubular portion (2.3). Thus, it is possible to arrange the top (2.1) in one of two positions of use of the cap, that is, a first position in which the top (2.1) is coupled to the base element (1) obstructing the drinking nozzle (1.1), and a second position in which said top (2.1) is uncoupled from the drinking nozzle (1.1), for example, for when the user is about to consume the liquid contained in the bottle or similar recipient.

Preferably, the hinge section (2.4) is arranged on the opposite side of the anti-tamper means (2.2). That is, it is preferred that the hinge section (2.4) and the anti-tamper means (2.2) be arranged on opposite sides of the cap.

For their part, the anti-tamper means (2.2) of the top (2.1) comprise an interlocking element (2.21), extended from a lower edge (2.11) of the top (2.1) and adapted to latch through the inside of a front window (2.22) made in the tubular portion (2.3).

Preferably, as shown in FIG. 3, the interlocking element (2.21) comprises a tab (2.211). The tab (2.211) ends in a front projection (2.212), extended towards the outside of the top (2.1), which is the portion of the interlocking element (2.21) that latches through the inside of the front window (2.22). See FIGS. 2 and 4.

Thus, as a result of coupling the top (2.1) to the drinking nozzle (1.1) of the base element (1) for the first time, the interlocking element (2.21) is caused to pass through an upper slit (2.33) (shown in FIG. 1), made in the upper side of the tubular portion (2.3) of the covering element (2), to finally latch through the inside of the front window (2.22).

The front projection (2.212) of the interlocking element (2.21) is preferred to be shaped frontally with a sloping surface that descends towards its free end, which facilitates the insertion of the interlocking element (2.21) through the upper slit (2.33), to then latch its front projection (2.212) into the front window (2.22).

In this way, the front projection (2.212) is retained in the front window (2.22), and looking through the latter, the front projection (2.212) can be seen at the back, an indication that the closure of the anti-tamper means (2.2) of the top (2.1) has been shaped, which provides the user with a visual indication of whether the top (2.1) has already been removed for a first time from the drinking nozzle (1.1) of the base element (1).

The first time the opening of the cap is carried out, that is, when attempting for the first time to uncouple the top (2.1) from the drinking nozzle (1.1), for example, by pressing upwards on a pushing projection (2.12) of the top (2.1), said action, causes the tab (2.211) to break, the front projection (2.212) of the interlocking element (2.21) falling from the front window (2.22). The irreversible breakage of the tab (2.211) leaves clues or a visual indication that the cap was previously opened, since the front projection (2,212) is no longer visible at the back of said front window (2.22), whereby, the bottle contents may have been tampered with.

With a view to facilitating breakage of the tab (2.211) during the decoupling between the top (2.1) and the drinking nozzle (1.1), it is preferred that said tab (2.211) comprises a weakening cut (2.2111).

On the other hand, it is preferred that the tubular portion (2.3) of the covering element (2) comprises an inner annular upper projection (2.31) adapted to fit in a cylindrical base wall (1.11) of the drinking nozzle (1.1), as well as, an inner annular lower projection (2.32) adapted to latch into an outer annular lower recess (1.21) of the substantially tubular portion (1.2) of the base element (1), when the covering element (2) is coupled to the base element (1). As shown in FIG. 5, the latching between said projection (2.32) and recess (1.21) prevents the separation of the elements (1, 2).

Similarly, see FIGS. 3 and 6, it is preferred that the substantially tubular portion (1.2) of the base element (1) comprises outer longitudinal projections (1.22) adapted to couple to inner longitudinal projections (2.34) of the tubular portion (2.3), when the covering element (2) is coupled to the base element (1), in this case preventing the rotation of the covering element (2) with respect to the base element (1).

For example, in the embodiment shown in FIGS. 3 and 6, the outer longitudinal projections (1.22) could be divided into groups, the latter, distributed equidistant from each other on the outside of the substantially tubular portion (1.2) of the base element (1), while the inner longitudinal projections (2.34) are conveniently distributed equidistant from each other on the inside of the tubular portion (2.3) of the covering element (2); wherein, when the coupling between both elements (1, 2) is carried out, an inner longitudinal projection (2.34) is tightly coupled between two outer longitudinal projections (1.22).

Additionally, as shown in FIG. 3, it is preferred that the substantially tubular portion (1.2) of the base element (1) comprises a threaded interior (1.25) adapted to screw onto the neck of the bottle or similar recipient.

Likewise, the substantially tubular portion (1.2) of the base element (1) may comprise an inner circular projection (1.26) adapted to fit inside the neck of the bottle or similar recipient.

Finally, as shown in FIGS. 3 and 4, it is preferred that the substantially tubular portion (1.2) of the base element (1) comprises a retention band (1.23), which is interconnected to the lower edge of the substantially tubular portion (1.2) by means of a breakable discontinuous portion (1.24). The retention band (1.23) comprises either an inner annular projection (not shown in the figures) or a plurality of inner projections (1.231) adapted to hold the retention band (1.23) retained to an annular collar (not shown in the figures) of the neck of the bottle or similar recipient.

Thus, when attempting to uncouple the cap from the neck of the bottle or recipient, for example, by unscrewing the base element (1), the breakable discontinuous portion (1.24) breaks, only the retention band (1.23) remaining on the neck of the bottle.

The irreversible breakage of the breakable discontinuous portion (1.24), in this case, leaves evidence that the cap was previously removed from the neck of the bottle or similar recipient.

The invention claimed is:

1. A cap for a drink bottle or similar recipient comprising:

a base element comprising an upper drinking nozzle and a substantially tubular lower portion adapted so that the base element can be secured to a neck of the bottle or similar recipient, a covering element comprising a flip top adapted to hermetically seal the drinking nozzle of the base element, and anti-tamper means of the top adapted to provide a visual indication of whether the top has already been removed for a first time from the drinking nozzle, wherein, the covering element comprises a tubular portion adapted to be secured to the outside of the substantially tubular portion of the base element, and the anti-tamper means of the top comprise an interlocking element being breakable from the flip top upon a pivotable movement of the flip top; the interlocking element being extended from a lower edge of the top, wherein the tubular portion of the covering element includes a slit such that the interlocking element is adapted to latch through the slit to inside of an exterior front window of the tubular portion of the covering element in a first position and visible through said exterior front window; and the interlocking element being adapted in a second position whereby said pivotable movement causes said interlocking element to separate such that the interlocking element is not visible through said exterior front window.

2. The cap according to claim 1, wherein the interlocking element comprises a tab ending in a front projection.

3. The cap according to claim 2, wherein the tab comprises a weakening cut.

4. The cap according to claim 1, wherein the covering element comprises a hinge section that joins the top to the tubular portion.

5. The cap according to claim 4, wherein the hinge section is arranged on the opposite side of the anti-tamper means.

6. The cap according to claim 1, wherein the tubular portion of the covering element comprises an inner annular upper projection adapted to fit in a cylindrical base wall of the drinking nozzle and an inner annular lower projection adapted to latch into an outer annular lower recess of the substantially tubular portion of the base element, when the covering element is coupled to the base element, preventing the separation of these elements.

7. The cap according to claim 1, wherein the substantially tubular portion of the base element comprises outer longitudinal projections adapted to couple with inner longitudinal projections of the tubular portion, preventing the rotation of the covering element with respect to the base element.

8. The cap according to claim 1, wherein the substantially tubular portion (1.2) of the base element comprises a threaded interior adapted to screw onto the neck of the bottle or similar recipient.

9. The cap according to claim 1, wherein the substantially tubular portion of the base element comprises an inner circular projection adapted to fit inside the neck of the bottle or similar recipient.

10. The cap according to claim 1, wherein the substantially tubular portion of the base element comprises a retaining band interconnected to its lower edge by means of a breakable discontinuous portion, a retention band comprising a plurality of inner projections adapted to hold the retention band retained to an annular collar of the neck of the bottle or similar recipient.

* * * * *